United States Patent [19]

Nehrbas, Jr.

[11] 4,323,246

[45] Apr. 6, 1982

[54] GOLF PRACTICE PUTTING AID

[76] Inventor: George M. Nehrbas, Jr., 218 Pershing Ave., Bethpage, N.Y. 11714

[21] Appl. No.: 79,835

[22] Filed: Sep. 28, 1979

[51] Int. Cl.[3] ..... A63B 69/36

[52] U.S. Cl. ..... 273/186 A

[58] Field of Search ..... 273/186 A, 162 E, 173, 273/174, 194 A, 194 B, 183 D, 175, 168, 163 R, 186 C, 194 R, 193 R

[56] References Cited

U.S. PATENT DOCUMENTS

| | | | |
|---|---|---|---|
| 2,057,821 | 10/1936 | Costello | 273/194 A |
| 2,660,436 | 11/1953 | Grossman | 273/194 A X |
| 3,021,141 | 2/1962 | Polsky et al. | 273/186 A |
| 3,039,776 | 6/1962 | Faini | 273/194 A X |
| 3,194,564 | 7/1965 | Swan | 273/168 X |
| 3,384,376 | 5/1968 | Greenlee | 273/194 A |
| 3,578,325 | 5/1971 | Teas | 273/175 X |
| 3,754,764 | 8/1973 | Manheck | 273/186 D |
| 3,810,633 | 5/1974 | Scott | 273/163 R X |
| 3,912,277 | 10/1975 | Pelz | 273/186 A |
| 4,002,343 | 1/1977 | Eckert | 273/163 R |
| 4,121,832 | 10/1978 | Ebbing | 273/173 X |
| 4,130,282 | 12/1978 | Pelz | 273/194 A |
| 4,139,198 | 2/1979 | Kanavas | 273/186 A |
| 4,153,255 | 5/1979 | Woodson | 273/186 A |

*Primary Examiner*—George J. Marlo

*Attorney, Agent, or Firm*—L. S. Van Landingham, Jr.

[57] ABSTRACT

A golf putting aid includes a pressure sensitive adhesive backing for removably attaching the aid to the striking face of a prior art putter without noticeably changing the characteristics of the putter. The putting aid preferably includes a pair of upright spaced parallel rails extending outward at 90° from the front surface of a backing member and terminating in spaced angular surfaces. When properly stroked with the putter, the angular surfaces allow a golf ball to pass therebetween and strike the front surface of the backing member thereby causing the golf ball to roll straight in the direction of the intended target. When the golf ball is improperly stroked, it strikes one of the angular surfaces and is turned away from the target.

13 Claims, 6 Drawing Figures

GOLF PRACTICE PUTTING AID

THE BACKGROUND OF THE INVENTION

1. The Field of the Invention

The present invention relates to a golf putting aid which may be removably attached to a prior art putter for use during putting practice, and thereafter detached whereby the same putter may be used in playing a round of golf. The invention is further concerned with a prior art putter having the golf putting aid of the invention removably attached thereto.

2. The Prior Art

Golf training devices of the type commonly referred to in this art as practice putting aids have been used heretofore in practice putting. Examples are disclosed in U.S. Pat. Nos. 2,057,821 3,021,141, 3,039,776, 3,194,564, 3,912,277, 4,025,078, and 4,130,282, the disclosures of which are incorporated herein by reference. These prior art putting aids were not entirely satisfactory for a number of reasons.

Many of the prior art putting aids were relatively large and heavy, and often the putter head had to be modified in order to provide mechanical means for attaching the putting aid to the striking face. As a result, these prior art putting aids could not be easily attached to an unmodified prior art putter for use during putting practice, and then detached therefrom whereby the same putter could be used while playing a round of golf. The prior art putting aids also had unusual configurations, or were sufficiently large and/or heavy to change the putting characteristics of the putter. Thus, they were not very effective as training aids due, among other reasons, to the change in putting characteristics while subsequently playing a round of golf.

Additionally, the prior art putting aids are relatively expensive to manufacture and thus tend to be costly to purchase and use effectively. This is especially true in instances where a special practice putter must be purchased in order to effectively use the prior art putting aids. In such instances, another putter, which often has different putting characteristics, must be purchased for use in playing a round of golf.

The aforementioned deficiencies and disadvantanges of the prior art putting aids have been long recognized by those skilled in this art. However, an entirely satisfactory putting aid, and/or a prior art putter incorporating the same, was not available prior to the present invention in spite of the long existing and great need therefor.

THE SUMMARY OF THE INVENTION

The present invention overcomes the aforementioned and other deficiencies and disadvantages of the prior art. This is accomplished by providing a golf putting aid of a novel and unique design which is highly effective for the intended purpose.

In one presently preferred embodiment of the invention, the putting aid includes a transversely extending backing member having front and rear surfaces. A pair of upright spaced rails extend outward from the front surface adjacent the ends of the backing member and preferably at substantially 90 degrees thereto. The pair of rails are substantially parallel and terminate on their outer ends in angular surfaces which are likewise substantially parallel to each other and also to the rear surface of the backing member. The angular terminal rail surfaces are sufficiently spaced apart to allow a golf ball to pass therebetween and strike the front surface of the backing member when the putting aid is attached to the striking face of a prior art putter and the golf ball is properly stroked with the putter. This allows the golf ball to roll straight in the general direction of the target. However, when the golf ball is improperly stroked with the putter, it strikes one of the angular terminal rail surfaces and is turned away from the intended target. At least that portion of the front surface of the backing member which is in contact with the golf ball when it is properly stroked with the putter is flat and substantially parallel with the rear surface. The rear surface of the backing member is also substantially flat and conforms with the striking face of the putter. It may be provided with a layer of pressure sensitive adhesive, doubled faced adhesive tape, or other suitable means for releasably attaching the putting aid to the striking face of the putter. The pressure sensitive adhesive, or the outer surface of the adhesive tape, may be covered with a sheet of a non-tacky material, such as waxed paper, to protect and preserve the adhesive properties thereof while awaiting use of the putting aid.

The aforementioned putting aid is removably, and preferably adhesively, attached to the striking face of a prior art putter prior to practicing putting. Thereafter, the putting aid is removed when it is desired to use the putter in playing a round of golf.

The putting aid is small, light in weight and durable, and it may be used indefinitely. The putting characteristics of the putter are not changed noticeably. The putting aid encourages and develops a golfer's ability to concentrate and aids in developing a consistent putting stroke.

Reference may be had to the following detailed description of the invention and the accompanying illustrative drawings for a more thorough and complete understanding of the invention.

A BRIEF DESCRIPTION OF THE ACCOMPANYING DRAWINGS

The invention will be described hereinafter in greater particularity with reference to the presently preferred embodiments thereof illustrated in the accompanying drawings, wherein.

The aforementioned figures of the drawings are referred to and discussed hereinafter in greater detail.

THE DETAILED DESCRIPTION OF THE INVENTION INCLUDING THE PRESENTLY PREFERRED EMBODIMENTS THEREOF

Figure 2:
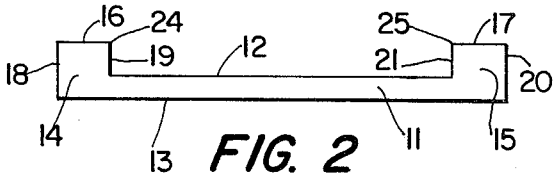
FIG. 2 is a bottom view of the putting aid of FIG. 1.
Figure 3:
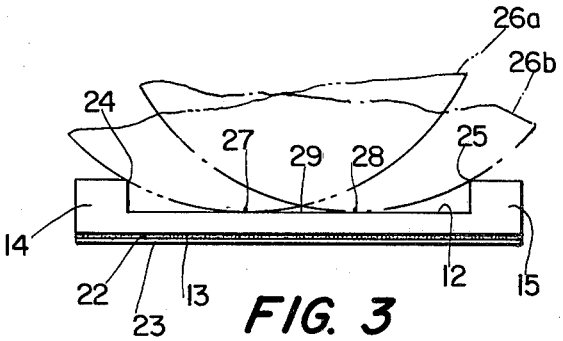
FIG. 3 is a bottom view of the putting aid of FIG. 1, additionally illustrating a layer of a tacky pressure sensitive adhesive on the rear surface thereof which is covered with a non-tacky protective sheet, and further illustrating the front surface area thereof which is capable of being contacted by a golf ball during putting practice.

Referring now to the drawings, which illustrate one presently preferred embodiment of the invention, the golf putting aid generally designated as 10 includes a backing member 11 having a front surface 12 and a rear surface 13. The backing member 11 extends transversely, and the rear surface 13 is substantially flat and smooth so as to conform with the striking face of a prior art putter. A pair of upright spaced rails 14 and 15 extend outward from the left and right end portions, respectively, of the front surface 12. As is best seen in FIGS. 2 and 3, the rails 14 and 15 preferably extend outward from the surface 12 of backing member 11 at substantially 90 degrees thereto and terminate in flat surfaces 16 and 17, respectively, which are substantially parallel to the rear surface 13 of backing member 11. Thus, the front surface 12, the rear surface 13, the terminal surface 16 and the terminal surface 17 are substantially parallel to each other, and the outer and inner side surfaces 18 and 19 of rail 14, and the other and inner side surfaces 20 and 21 of rail 15, form substantially 90 degrees angles therewith. As is best seen in FIG. 3, the rear surface 13 is preferably covered with a layer of tacky pressure sensitive adhesive or a double faced adhesive tape 22 which in turn is covered with a sheet of a non-tacky material such as waxed paper 23 to protect the adhesive properties thereof until the putting aid 10 is ready to be attached to the striking face of a putter.

Figure 1:
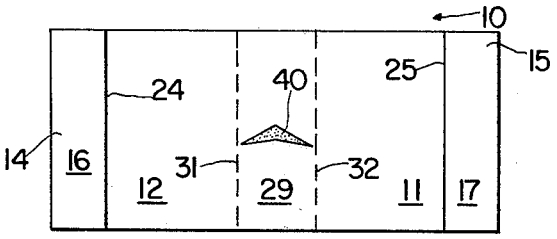
FIG. 1 is a front view in elevation of the golf putting aid of the invention.
Figure 6:
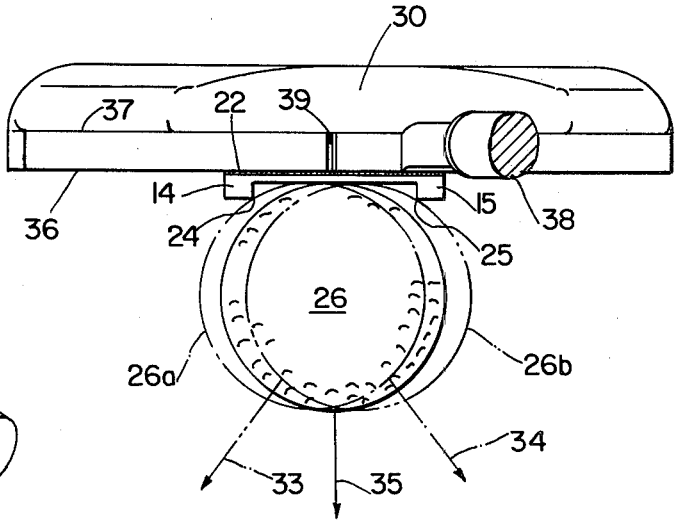
FIG. 6 is a top view of FIG. 5.
Figure 5:
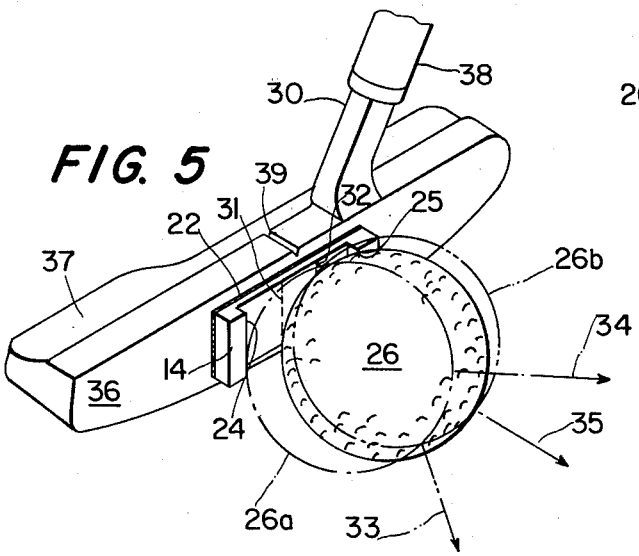
FIG. 5 is a perspective view of the putter of FIG. 4, further illustrating the use thereof in putting practice.

Medial sharp angular surfaces or edges 24 and 25 are formed at the intersection of surfaces 16 and 19, and at the intersection of surfaces 17 and 21, respectively. As may be seen in FIGS. 3, 5 and 6 of the drawings, the angular surfaces 24 and 25 contact and deflect the golf ball 26 when it is improperly stroked with the prior art putter 30. When the golf ball 26-*a* rests on surface 12 while also resting against the angular surface 24, the circumference thereof touches surface 12 at point 27 of FIG. 3 and along line 31 of FIG. 1. Similarly, when the golf ball 26-*b* rests on surface 12 while also resting against the angular surface 25, the circumference thereof touches surface 12 at point 28 of FIG. 3 and along line 32 of FIG. 1. It is apparent that the golf ball 26 should be stroked with putter 30 so as to avoid the angular surfaces 24 and 25 and contact only the vertically extending area 29 of surface 12 which lies within the circumferential points 27 and 28 of FIG. 3 and the lines 31 and 32 of FIG. 1. Otherwise, the golf ball 26 will first contact the angular surface 24 or 25 and be deflected as is shown in FIGS. 5 and 6 by the side arrows 33 and 34, respectively. When the golf ball 26 hits only surface 29, it will roll true in the general direction of the target, as is shown by the straight arrow 35.

There are several important relationships between the rear surface 13 of backing member 11, the portion of front surface 12 falling within the area 29, and the angular surfaces 24 and 25. For example, the surface 13 should be substantially smooth and flat so as to conform with the smooth and flat striking surface 36 on putter head 37. The surface of area 29 which contacts golf ball 26 should be substantially smooth and flat and also parallel with the surface 13, so as to be in effect an extension of the striking surface 36. When taken in combination with the small size and light weight of putting aid 10, the above assures that the putting characteristics of the prior art putter 30 do not change noticeably during practice putting and thus comparable results are achieved during both practice and actual play. The angular surfaces 24 and 25 are sharp and immediately deflect the golf ball to the sides upon contact. Finally, the angular surfaces 24 and 25 are substantially parallel to the rear surface 13, and this assures that the vertical area 29 is of substantially the same width as it extends from the top of the surface area 12 to the bottom thereof.

The width of the area 29 is of importance as it largely determines the degree of skill required to strike the ball 26 with the striking face 36 without contacting the angular surfaces 24 and 25 and being deflected thereby. When using an official United States Golf Association golf ball having a diameter of 1.680 inches, the width of the substantially vertical surface area 29 should be between 3/16 inch and $\frac{3}{8}$ inch. A golfer of average skill often prefers a width of about $\frac{1}{4}$ inch, while a professional or highly skilled golfer often prefers a width of about 7/32 inch. When an official British golf ball having a diameter of 1.620 inches is used, the aforementioned widths may be slightly less to compensate for the smaller ball that is used.

Figure 4:
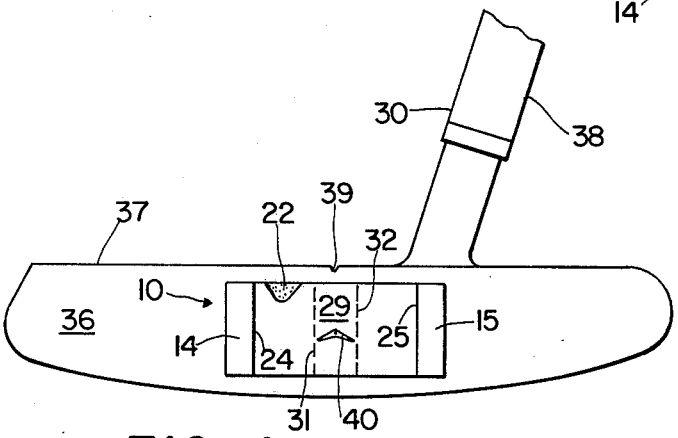
FIG. 4 is a side view in elevation illustrating the golf putting aid of FIGS. 1–3 attached to the striking face of a prior art putter.

Referring now to FIGS. 4, 5 and 6, the putting aid 10 is shown removably attached to the striking face 36 of the putter head 37 on a prior art putter 30 having the usual shaft 38. Preferably, the putting aid 10 is removably attached to striking face 36 with an adhesive means, such as a layer of double faced pressure sensitive adhesive tape or a layer of a suitable adhesive on the surface 13. The putting aid 10 is carefully positioned on the striking face 36 so that the arrow 40 thereon, which is at the geomeric center of area 29, is placed below the marker 39 and over the "sweet spot" or center of gravity of putter head 37. It is essential that the putting aid 10 be so positioned, as otherwise it is not as effective for the intended purpose.

The prior art putter 30 may be used as a practice putter in the manner generally illustrated in FIGS. 5 and 6 of the drawings immediately following attachment of the putting aid 10. As is noted therein, when golf ball 26 is hit solidly and so as to avoid the angular surfaces 24 and 25, it moves straight forward in the direction of the arrow 35 toward the desired target. When the golf ball 26 is not hit solidly, as is shown in the phantom line identified as 26-*a* or 26-*b*, it strikes the angular surface 24 or 25 and is deflected in the direction of side arrow 33 or 34. Inasmuch as the putter 30 with the putting aid 10 attached thereto has the same putting characteristics during practice as when playing a round of golf with the putting aid removed, it is apparent that a golfer may rapidly improve his putting proficiency. When the putting practice has been completed, the putting aid 10 is simply removed from the striking face 36 and the putter 30 is ready for use in regular play.

It is apparent from the foregoing that the golf practice putting aid trains one to strike a predetermined center of gravity on the striking face of a prior art putter. The center of gravity is located by the golfer and then the golf practice putting aid 10 is lined up with this center of gravity as previously described.

The putting aid 10 is preferably constructed of a relatively hard, strong and durable plastic, and especially those commonly referred to in the art as engineering plastics. Examples of plastics include the polycarbonate plastics which are often preferred, and the methyl methacrylate polyesters, polyolefins, and the like. Plastics sold under the trademarks LEXAN ® and PLEXIGLAS® are very useful, and the former usually gives the best results. It is also possible, but not usually preferred, to use light metals such as aluminum, magnesium, and alloys thereof.

Any suitable means may be employed for attaching the putting aid 10 to the striking face 36 provided it is removable and does not change the putting characteristics of the putter 30. Adhesives and especially pressure sensitive adhesives are usually preferred. The adhesive may be in the form of an adhesive layer that is applied directly to the surface 13 and/or to the surface of striking face 36, or it may be in the form of a tape or other thin substrate which is coated on both sides with a suitable pressure sensitive adhesive. It is understood that a prior art adhesive is selected which will allow the putting aid 10 to be easily removed from the striking face 36 following putting practice, and also re-attached thereto as often as desired for future putting practice. Suitable double faced adhesive tape coated with a pressure sensitive adhesive and/or adhesive compositions per se, such as rubber cement or other elastomeric polymer cements, are commercial products and are readily available.

The foregoing detailed description and the accompanying drawings are for purposes of illustration only, and are not intended to be limited to the spirit or scope of the appended claims.

I claim:

1. A golf practice putting aid for removably attaching to the substantially flat striking surface of the putter head of a putter normally used in playing a round of golf comprising a transversely extending backing member, the backing member having transversely spaced first and second end portions, spaced top and bottom portions and front and rear surfaces, first and second spaced upright rail means carried by the said front surface of the backing member and running continuously between the said top and bottom portions of the backing member, the first rail means extending substantially uniformly outward from the said front surface on the first end portion of the backing member, the second rail means extending substantially uniformly outward from the said front surface on the second end portion of the backing member, the first rail means including elongated upright first angular surface means and the second rail means including elongated upright second angular surface means, the first and second angular surface means extending continuously between the said top and bottom portions of the backing member and being spaced substantially uniformly outward from the said front surface of the backing member, the first and second angular surface means also being substantially parallel and spaced outward from the front surface of the backing member at substantially the same distance, the first and second angular surface means being spaced apart transversely a distance sufficient to provide an upright medial surface area on the said front surface between the first and second rail means of a width which may be contacted with the circumferential surface of a golf ball without also contacting either of the first and second angular surface means, the said medial surface area on the front surface extending between the said top and bottom portions of the backing member and having a width between 3/16 inch and ⅜ inch, the first and second angular surface means being positioned on the first and second rail means respectively whereby the circumferential surface of a golf ball contacting the said front surface outside of the said medial surface area also contacts at least one on the first and second angular surface means, the said rear surface of the backing member and the said medial surface area being substantially flat and parallel whereby the said rear surface conforms to the substantially flat striking face of a putter head and the said medial surface area serves as an extension of the striking face of the putter head that is visible to a golfer when practice putting, the said first and second angular surface means being substantially parallel to the said rear surface and also substantially the same distance therefrom and from each other whereby the width of the said medial surface area does not vary substantially, a tacky pressure sensitive adhesive carried by the said rear surface for securely but removably attaching the entire rear surface area thereof to the said striking face of a putter head whereby the attached putting aid does not noticeably vibrate and has a solid feel when the geometric center of the said medial surface area is struck by a golf ball, and the said putting aid being sufficiently light in weight so that it does not added noticeable weight to the said putter head and also does not noticeably change the center of gravity of the said putter head.

2. The golf practice putting aid of claim 1 wherein the width of the said medial surface area is about ¼ inch.

3. The golf practice putting aid of claim 1 wherein a removable non-tacky protective substrate is applied over the adhesive when the said putting aid is not in use to aid in preserving the adhesive properties thereof.

4. The golf putting aid of claim 1 wherein a visible marking means is applied to substantially the geometric center of the said medial area to thereby aid in positioning the putting aid on the striking face of the putter head at substantially its center of gravity, and the component elements of the putting aid have configurations and are so proportioned that a traverse plane parallel to the said top and bottom portions and taken through the said marking means divides the putting aid into symmetrical upper and lower halves and a vertical plane parallel to the said first and second end portions and taken through the said marking means divides the putting aid into symmetrical left and right halves.

5. The golf putting aid of claim 1 wherein it is constructed from a strong and durable light weight plastic material which does not add a substantial amount of weight to the putter head and does not substantially change the center of gravity of the putter head.

6. The golf putting aid of claim 1 wherein a non-tacky protective substrate is applied over the adhesive to aid in preserving the adhesive properties thereof, a visible marking means is applied to substantially the geometric center of the said medial surface area to thereby aid in positioning the putting aid on the striking face of the putter at substantially its center of gravity, and the component elements of the putting aid have configurations and are so proportioned that a transverse plane parallel to the said top and bottom portions and taken through the said marking means divides the putting aid into symmetrical upper and lower halves and a vertical plane parallel to the said first and second end portions and taken through the said marking means divides the putting aid into symmetrical left and right halves, and the golf putting aid is constructed from a strong and durable light weight plastic material which does not add a substantial amount of weight to the putter head and does not substantially change the center of gravity of the putter head.

7. The golf practice putting aid of claim 6 wherein the width of the same medial surface area is about $\frac{1}{4}$ inch.

8. In a golf putter including a putter head carried by a shaft, the putter head having a striking face normally struck by a golf ball when putting and a center of gravity, the improvement which comprises the golf practice putting aid of claim 1 mounted solely on the said striking face, the entire surface area of the said rear surface of the putting aid being securely attached to the surface of the said striking face whereby the putting aid including the said backing member serves as an extension of the said striking face and does not noticeably vibrate and has a solid feel when the geometric center of the said medial surface area is struck by a golf ball, the putting aid having a size and shape and being mounted whereby the peripheral edges thereof do not extend past the peripheral edges of the said striking face, the said putting aid being sufficiently light in weight so that it does not add noticeable weight to the putter and also does not noticeably change the center of gravity of the putter, and the said putting aid being positioned whereby the portion of the said striking face normally struck by a golf ball when putting is covered by the putting aid and the geometric center of the said medial area is positioned over the said center of gravity to thereby allow the golf putter to be used effectively in putting practice without noticeably changing the putting characteristics thereof.

9. The golf putter of claim 8 wherein the width of the said medial surface area is about $\frac{1}{4}$ inch.

10. The golf putter of claim 8 wherein the said putting aid is in accordance with claim 3.

11. The golf putter of claim 8 wherein the said putting aid is in accordance with claim 4.

12. The golf putter of claim 8 wherein the said putting aid is in accordance with claim 5.

13. The golf putter of claim 8 wherein the putting aid is in accordance with claim 8.

* * * * *